US011346257B2

(12) United States Patent
Andrisani

(10) Patent No.: US 11,346,257 B2
(45) Date of Patent: May 31, 2022

(54) ACTUATION ARRANGEMENT FOR A VALVE TRAIN ASSEMBLY

(71) Applicant: Eaton Intelligent Power Limited, Dublin (IE)

(72) Inventor: Nicola Andrisani, Cumiana (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/756,491

(22) PCT Filed: Oct. 17, 2018

(86) PCT No.: PCT/EP2018/078333
§ 371 (c)(1),
(2) Date: Apr. 16, 2020

(87) PCT Pub. No.: WO2019/076945
PCT Pub. Date: Apr. 25, 2019

(65) Prior Publication Data

US 2020/0340374 A1 Oct. 29, 2020

(30) Foreign Application Priority Data

Oct. 20, 2017 (GB) ..... 1717280

(51) Int. Cl.
*F01L 1/34* (2006.01)
*F01L 1/18* (2006.01)
*F01L 13/00* (2006.01)

(52) U.S. Cl.
CPC ..... *F01L 1/185* (2013.01); *F01L 13/0036* (2013.01); *F01L 2001/186* (2013.01);
(Continued)

(58) Field of Classification Search
CPC . F01L 1/185; F01L 13/0036; F01L 2001/186; F01L 2013/001;
(Continued)

(56) References Cited

U.S. PATENT DOCUMENTS 7,841,311 B2 11/2010 Hutcheson et al.
2012/0138000 A1 6/2012 Schaedel et al.
(Continued)

FOREIGN PATENT DOCUMENTS

CN 103857882 B 6/2017
EP 2339150 A2 6/2011
(Continued)

*Primary Examiner* — Zelalem Eshete
(74) *Attorney, Agent, or Firm* — Mei & Mark, LLP

(57) ABSTRACT

An actuation arrangement for actuating a plurality of latching arrangements of a respective plurality of dual body rocker arms of a valve train assembly of an internal combustion engine includes: a first shaft comprising one or more first selector cam for controlling the latching arrangements of a first group of one or more of the dual body rocker arms; and a second shaft comprising one or more second selector cams for controlling the latching arrangements of a second group of one or more of the dual body rocker arms. At least a portion of the first shaft is received in the second shaft, and the first shaft and the second shaft are controllable to rotate independently of one another, thereby to allow control of the latching arrangements of the dual body rocker arms on a per group basis.

19 Claims, 3 Drawing Sheets

(52) U.S. Cl.
CPC ... *F01L 2013/001* (2013.01); *F01L 2013/103* (2013.01); *F01L 2820/033* (2013.01)

(58) Field of Classification Search
CPC ..... F01L 2013/103; F01L 2820/033; F01L 2820/03; F01L 2820/031; F01L 13/0005; F01L 13/065; F01L 2013/105; F01L 2305/00
See application file for complete search history.

(56) References Cited

U.S. PATENT DOCUMENTS

| | | | | |
|---|---|---|---|---|
| 2014/0026874 | A1 | 1/2014 | Dean et al. | |
| 2017/0159791 | A1 | 6/2017 | Flender et al. | |
| 2017/0198613 | A1* | 7/2017 | Raimondi ..... | F01L 1/14 |

FOREIGN PATENT DOCUMENTS

| | | | |
|---|---|---|---|
| EP | 3176391 | A1 | 6/2017 |
| WO | 2013053421 | A1 | 4/2013 |
| WO | WO 2017144706 | A1 | 8/2017 |

* cited by examiner

ACTUATION ARRANGEMENT FOR A VALVE TRAIN ASSEMBLY

CROSS-REFERENCE TO PRIOR APPLICATIONS

This application is a U.S. National Phase application under 35 U.S.C. § 371 of International Application No. PCT/EP2018/078333, filed on Oct. 17, 2018, and claims benefit to British Patent Application No. GB 1717280.0, filed on Oct. 20, 2017. The International Application was published in English on Apr. 25, 2019 as WO/2019/076945 under PCT Article 21(2).

FIELD

The invention relates to an actuation arrangement for a valve train assembly for an internal combustion engine, and more specifically to an actuation arrangement to allow control of dual body rocker arms on a per group basis.

BACKGROUND

Internal combustion engines may comprise switchable engine or valve train components. For example, valve train assemblies may comprise a switchable rocker arm to provide for control of valve actuation (for example exhaust or inlet valve actuation and/or de-actuation) by alternating between at least two or more modes of operation (e.g. valve-lift modes). Such rocker arms typically involve multiple bodies, such as an inner arm and an outer arm. These bodies are latched together by a latching system comprising a movable latch pin to provide one mode of operation (e.g. a first valve-lift mode (e.g. normal engine combustion mode) and are unlatched, and hence can pivot with respect to each other, to provide a second mode of operation (e.g. a second valve-lift mode (e.g. valve de-activation mode). Typically, the moveable latch pin is used and actuated and de-actuated to switch between the two modes of operation.

SUMMARY

In an embodiment, the present invention provides an actuation arrangement for actuating a plurality of latching arrangements of a respective plurality of dual body rocker arms of a valve train assembly of an internal combustion engine, the actuation arrangement comprising: a first shaft comprising one or more first selector cam configured to control the latching arrangements of a first group of one or more of the dual body rocker arms; and a second shaft comprising one or more second selector cams configured to control the latching arrangements of a second group of one or more of the dual body rocker arms, wherein at least a portion of the first shaft is received in the second shaft, and the first shaft and the second shaft are controllable to rotate independently of one another, thereby to allow control of the latching arrangements of the dual body rocker arms on a per group basis.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
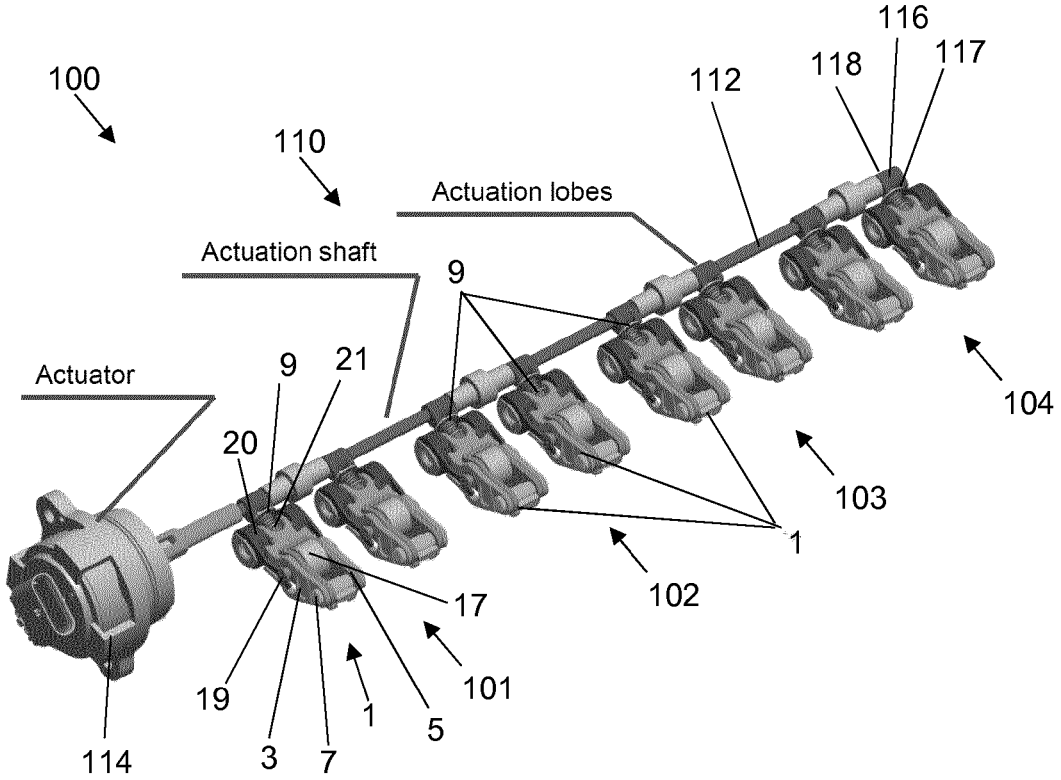
FIG. 1 illustrates schematically a perspective view of a valve train assembly.

Referring to FIG. 1, there is illustrated a valve train assembly 100 comprising four pairs 101 to 104 of rocker arms 1, and an actuation arrangement 110 for actuating latching arrangements 9 of each rocker arm 1.

In the example of FIG. 1, each respective pair of rocker arms 101 to 104 is for controlling a pair of valves (e.g. exhaust or inlet) on a respective cylinder of an internal combustion engine (e.g. the arrangement relates to a 4-cylinder engine in this example).

Each dual body rocker arm 1 comprises an outer body 3 and an inner body 5 that are pivotably connected together at a pivot axis 7. The latching arrangement 9 of each rocker arm 1 comprises a latch pin slidably supported in a bore in the outer body 3 and which can be urged between a first configuration in which the latch pin latches the outer body 3 and the inner body 5 together and a second configuration in which the outer body 3 and the inner body 5 are unlatched. In this example, the latching arrangement 9 is biased to the unlatched configuration by a return spring 21.

In the first configuration, the outer body 3 and the inner body 5 are latched together and hence can move or pivot about a pivot point as a single body so that the that rocker arm 1 provides a first primary function, for example, an engine valve that it controls is activated as a result of the rocker arm 1 pivoting as a whole about a pivot point (e.g. about a Hydraulic lash adjuster) and exerting an opening force on the valve.

In the second configuration, the outer body 3 and the inner body 5 are un-latched so that the inner body 5, for example, can pivot freely with respect to the outer body 3 about the pivot axis 7 so that rocker arm 1 provides a second secondary function, for example, the valve it controls is de-activated (e.g. to provide cylinder de-activation) as a result of lost motion absorbed by the inner body 5 pivoting freely with respect to the outer body 3 and hence no opening force being applied to the valve.

The inner body 5 is provided with an inner body cam follower 17, in this example, a roller follower 17 rotatably mounted (for example with bearings) on an axle 19 for following an auxiliary cam profile on a cam shaft and the outer body 3 is provided with a pair of cam followers, in this example a pair of slider pads, arranged either side of the roller follower 17 for following a pair of primary cam profiles mounted on the cam shaft.

The rocker arm 1 further comprises a return spring arrangement 20 for biasing the inner body 5 to its rest position after it is has pivoted with respect to the outer body 3.

Although a particular example rocker arm 1 is described above, it will be appreciated that each dual body rocker arm 1 may be any switchable rocker arm arranged to provide for control of valve actuation (for example exhaust or inlet valve actuation and/or de-actuation) by alternating between at least two modes of operation (e.g. valve-lift modes). For example, the rocker arm 1 may be any dual body rocker arm 1 having a first body 3 and a second body 5 that may be latched together by a latching arrangement 9 to provide one mode of operation (e.g. a first valve-lift mode (e.g. normal engine combustion mode) and that may be unlatched, and hence can pivot with respect to each other, to provide a second mode of operation (e.g. a second valve-lift mode (e.g. valve de-activation mode).

In this example, the actuation arrangement 110 comprises an elongate shaft 112 that is rotatable by an actuator 114, for example an electric motor 114. The actuation arrangement 110 comprises a plurality of components 116, in this example, selector cams 116, one for each rocker arm 1, mounted on the shaft 112 for operating the latching arrangements 9. Each selector cam 116 comprises a lobe profile 117 and a base circle 118.

The actuator 114 is able to move or rotate the shaft 112 between first and second configurations. In the first configuration, the cam lobe profiles 117 of the selector cams 116 push or act on the latching arrangements 9 (as illustrated in FIG. 1) causing the latch pins to be in the latched position. In the second configuration, the cam lobe profiles 117 of the selector cams 116 do not act on the latching arrangements 9 of the rocker arms 1 allowing the return springs 21 to cause the latch pins 11 to be in the un-latched position.

It may be desirable to provide an actuation arrangement able to allow control some of the rocker arms 1 independently from others of the rocker arms 2, for example to allow control the function provided by some of the rocker arms 1 independently from the control of the function of other of the rocker arms 1.

Figure 2:
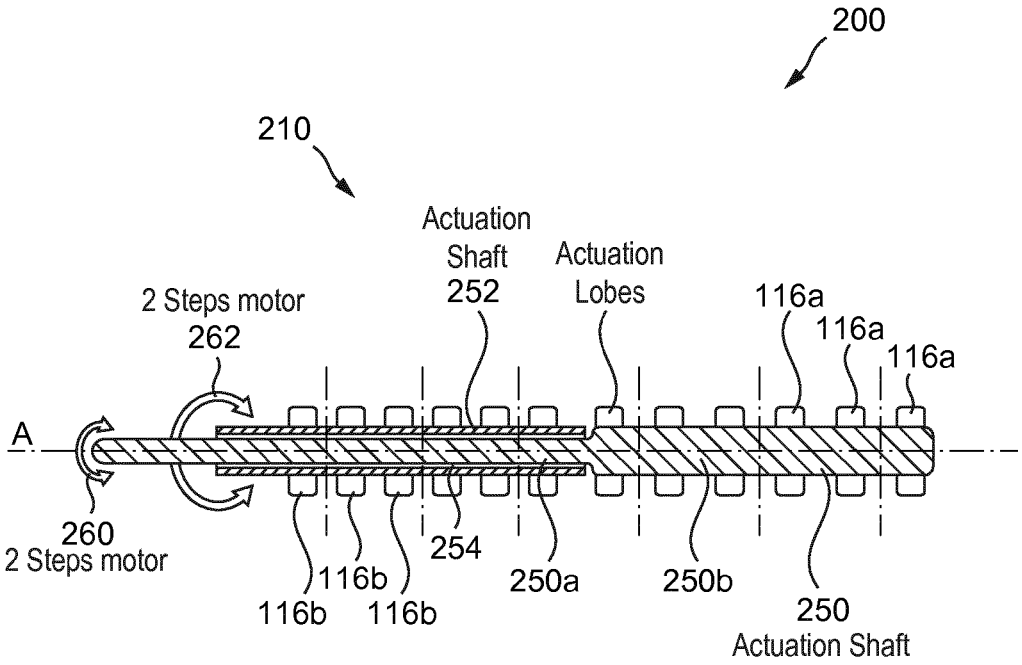
FIG. 2 illustrates schematically a cross sectional view of an actuation arrangement according to a first example.

FIG. 2 illustrates schematically a valve train assembly 200 comprising an actuation arrangement 210 according to a first example, that allows such control. Similarly to the above actuation arrangement 110 described with reference to FIG. 1, the actuation arrangement 210 of this first example is for actuating a plurality of latching arrangements (not shown in FIG. 2) of a respective plurality of dual body rocker arms (not shown in FIG. 2) of a valve train assembly 200 of an internal combustion engine. Each dual body rocker arm may be the same or similar to the rocker arm 1 described above. For example, each dual body rocker arm may comprise a first body, a second body, and a latching arrangement for latching and unlatching the first body and the second body.

However, in this example, the actuation arrangement 210 comprises a first shaft 250 comprising one or more first selector cams 116*a* for controlling the latching arrangements (not shown in FIG. 2) of a first group of one or more of the dual body rocker arms (not shown in FIG. 2), and a second shaft 252 comprising one or more second selector cams 116*b* for controlling the latching arrangements (not shown in FIG. 2) of a second group of one or more of the dual body rocker arms (not shown in FIG. 2). The first shaft 250 and the second shaft 252 are controllable to rotate independently of one another, thereby to allow control of the latching arrangements of the dual body rocker arms on a per group basis.

The first shaft 250 and the second shaft 252 are generally elongate. A first portion 250*a* of the first shaft 250 is received in the second shaft 252. Specifically, the second shaft 252 defines a channel 254 extending therethrough in which the first portion 250*a* of the first shaft 250 is received. The first portion 250*a* of the first shaft 250 extends through the entire length of the channel 254. The second shaft 252 is generally tube shaped, and the channel 254 defined buy the second shaft 252 is generally cylindrical. The first portion 250*a* of the first shaft 250 is also generally cylindrical and is arranged to fit into the channel 254 in the second shaft 253 and to freely rotate therein. The first shaft 250 and the second shaft 252 are substantially co-axial (see common 15 axis A).

A second portion 250*b* of the first shaft 250 is not received within the second shaft 252 and extends away from channel 254 of the second shaft 252. The second portion 250*b* of the first shaft 250 has a diameter larger than that of the first portion 250*a* of the first shaft 250. An outer diameter of the second portion 250*b* of the first shaft 250 may be the same or similar to an outer diameter of the second shaft 252.

In this example, the second portion 250*b* of the first shaft 250 comprises the one or more (in this example six) first selector cams 116*a* for controlling the latching arrangements (not shown in FIG. 2) of the first group of one or more (in this example six) respective dual body rocker arms (this example relates to a 6-cylinder engine) (not shown in FIG. 2). The second shaft 252 comprises six second selector cams 116*b* for controlling the latching arrangements of the second group (in this example 6) respective dual body rocker arms (not shown in FIG. 2).

Each of the dual body rocker arm are for controlling a valve of an internal combustion engine. In this example, the first group comprises three pairs of rocker arms, each respective pair for controlling a pair of valves (e.g. exhaust or inlet) on a respective cylinder of a first group of three cylinders of an internal combustion engine. Similarly, the second group comprises three pairs of rocker arms each respective pair for controlling a pair of valves (e.g. exhaust or inlet) on a respective cylinder of a second group of three cylinders of an internal combustion engine. (e.g. the arrangement relates to a 6-cylinder engine in this example). It will be appreciated that although in this example there are six cylinders, this need not necessarily be the case and in other examples, the first group may comprises one or more pairs of dual body rocker arms each for controlling valves of a first group of one or more cylinders of the internal combustion engine, and the second group may comprise one or more pairs of dual body rocker arms each for controlling valves of a second group of one or more cylinders of the internal combustion engine.

The actuation arrangement 210 comprises a first actuation source 260 connected to the first shaft 250 and arranged to rotate the first shaft 250, and a second actuation source 262 connected to the second shaft 252 and arranged to rotate the second shaft 252. The first actuation 260 source is mechanically connected to the first portion 250*a* of the first shaft. The first 260 and second 262 actuation source are located on a side of the second shaft 252 opposite to the second portion 250*b* of the first shaft 250. The first portion 250*a* of the first shaft 250 extends out beyond the second shaft 252 for connection to the first actuation source 260.

In this example, the first actuation source 260 comprises a first two-step or ON/OFF actuator, and the second actuation source 262 comprises a second twostep or ON/OFF actuator. The actuators may be or comprise for example electromagnetic or hydraulic actuators. The first actuation source 260 and the second actuation source 262 may form an integral unit.

In use, when it desired that a function provided by the first group of rocker arms is to be changed, but that a function provided by the second group of rocker arms is not to be changed, the first actuation source 260 may be controlled (for example by an engine management system) to rotate the first shaft 250 so as to change the orientation of the first selector cams 116*a* with respect to each of the latching arrangements of the first group of rocker arms, thereby causing the latching arrangements to move from one to the other of the latched configuration and the unlatched configuration, thereby to change the function (e.g. for example a valve lift mode) of the first group of rocker arms.

Similarly, when it desired that a function provided by the second group of rocker arms is to be changed, but that a function provided by the first group of rocker arms is not to be changed, the second actuation source 262 may be controlled (for example by an engine management system) to rotate the second shaft 252 so as to change the orientation of the second selector cams 116*b* with respect to each of the latching arrangements of the second group of rocker arms, thereby causing the latching arrangements to move from one to the other of the latched configuration and the unlatched configuration, thereby to change the function (e.g. for example a valve lift mode) of the second group of rocker arms.

When it desired that a function provided by the first and second group of rocker arms is to be changed, the first 260 and second 262 actuation source may be both controlled (for example by an engine management system) to rotate the first shaft 250 and the second shaft 252, respectively, so as to change the orientation of the first 116*a* and second 166*b* selector cams with respect to each of the latching arrangements of the first and second group of rocker arms, thereby causing the latching arrangements to move from one to the other of the latched configuration and the unlatched configuration, thereby to change the function (e.g. for example a valve lift mode) of the first and second group of rocker arms.

The actuation arrangement 210 therefore enables the use of a simple actuator, incorporating two basic ON/OFF actuators 260, 262 integrated into a single block, delivering a multiple step actuation control while solving the problem of the integration in the engine. As compared to the example of FIG. 1, the actuation shaft 250, 252 and actuation source in this example are split to achieve multi-step type actuation control using two simple ON/OFF actuators 260, 262. This may provide a simpler and more efficient solution, for example as compared to using a single shaft with differently shaped lobes and using a complex electric actuator (for example a multi-step actuator or stepper motor).

Figure 3:
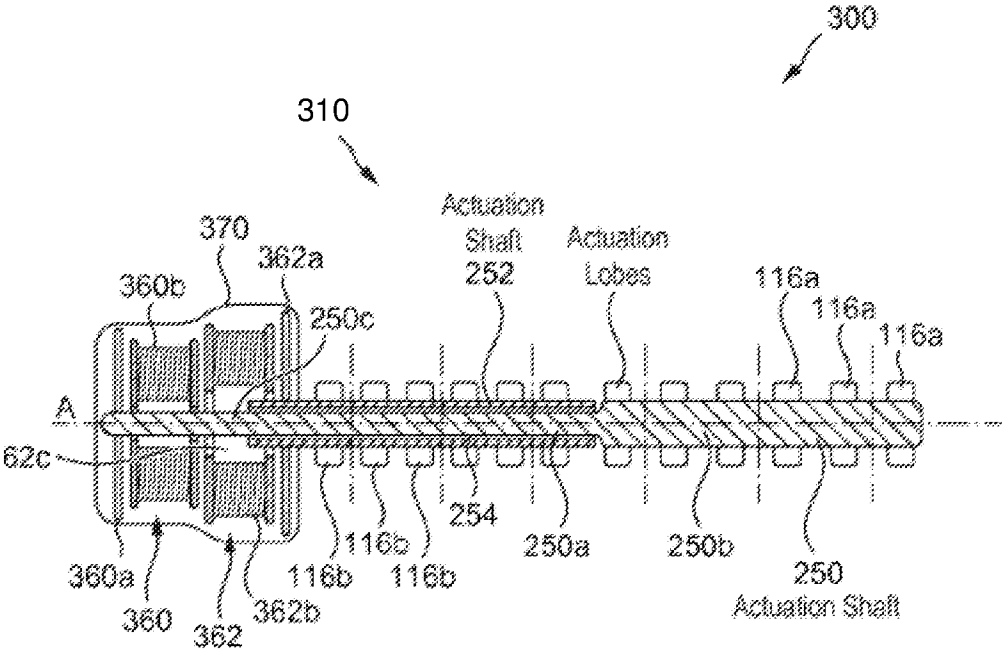
FIG. 3 illustrates schematically a cross sectional view of an actuation arrangement according to a second example.

Referring now to FIG. 3, there is shown a valve train assembly 300 comprising an actuation arrangement 310 according to a second example. The second example is similar to the first example described with reference to FIG. 2. Features which are the same or similar to as in the first example will not be described in detail again. Like features are given like reference signs.

As with the first example described with reference to FIG. 2, in this second example with reference to FIG. 3, the actuation arrangement 310 comprises a first shaft 250 comprising six first selector cams 116 *a* for controlling the latching arrangements of a first group of six (e.g. three pairs of) dual body rocker arms; and a second shaft 252 comprising six second selector cams 116 *b* for controlling the latching arrangements of a second group of six (e.g. three pairs of) dual body rocker arms; where at least a portion of the first shaft 250 is received in the second shaft 252 and the first shaft 250 and the second shaft 252 are controllable to rotate independently of one another, by a first 360 and second 362 actuation source respectively, thereby to allow control of the latching arrangements of the dual body rocker arms on a per group basis.

However, in this second example, the first actuation source 360 is or comprises a first torque motor 360 and the second actuation source 362 is or comprises a second torque motor 362. The first 360 and second 362 torque motors may each be a two-step motor. The first 360 and second 362 torque motors are coaxial (se e.g. axis A in FIG. 3)

The first torque motor 360 is connected to the first shaft 250 and is arranged to rotate the first shaft 250, and the second torque motor 362 is connected to the second shaft 252 and is arranged to rotate the second shaft 252. Specifically, the first torque motor 360 comprises a first rotor 360 *a* and a first stator 360 *b*. The second torque motor 362 comprises a second rotor 362 *a* and a second stator 362 *b*. The first 360 *b* and second 362 *b* stators comprise bobbin packs. The bobbin packs may be as known per se in electric motors. The first rotor 360 *a* of the first torque motor 360 is connected to the first shaft 250, and the second rotor 362 *a* of the second torque motor 362 is connected to the second shaft 252. The first torque motor 360 is coaxial with the second torque motor 362.

A portion 250*c* of the first shaft 250 extends through the second torque motor 362, thereby to be connected to the first torque motor 360. Specifically, the second rotor 362*a* and the second stator 362*b* of the second torque motor 362 define a substantially cylindrical cavity 362*c* that is coaxial with the second shaft 252. The portion 250*c* of the first shaft 250 extends out beyond the channel 254 of the second shaft 252, and through the cylindrical cavity 362*c*, for connection with the first rotor 360*a* of the first torque motor 360. In this example, the first rotor 360*a* of the first torque motor 360 is on a side of the first torque motor 360 facing away from the second shaft 252, and the second rotor 362*a* of the second torque motor 362 is on a side of the second torque motor 362 facing towards the second shaft 252.

The first torque motor 360 and the second torque motor 362 are packaged or housed in a single body 370. This may be a space efficient arrangement, and allow for more convenient installation of the actuator 370 onto the engine.

Similarly to as described above for the first example, in this second example, the first torque motor 360 and the second torque motor 362 may be controlled independently (for example by an engine management system) similarly to as described above, to allow independent control of the rotation of the first shaft 250 and the second shaft 252, and hence for independent control the latching arrangements of a first and second group of rocker arms controlling valves of a respective first and second group of cylinders.

Each rocker arm 1 in any of the above examples may provide for any switchable valve operating mode, for example an exhaust deactivation mode, variable valve timing mode, exhaust gas recirculation mode, compression brake mode etc.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

REFERENCE SIGNS LIST

1 rocker arm
3 outer body
5 inner body
7 pivot axis
9 latching arrangement
17 roller follower
19 axis
20 return spring arrangement
21 return spring
100, 200, 300 valve train assembly
101, 102, 103, 104 pairs of rocker arms
110, 210, 310 actuation arrangement
112 shaft
114 actuator
116 selector cam
116*a* first selector cam
116*b* second selector cam
117 lobed profile
118 base circle
250 first shaft
250*a* first portion
250*b* second portion
250*c* third portion
252 second shaft
254 channel
260, 360 first actuation source
262, 362 second actuation source
360*a*, 362*a* rotor
360*b*, 362*b* stator
362*c* cavity
370 housing

The invention claimed is:

1. An actuation arrangement for actuating a plurality of latching arrangements of a respective plurality of dual body rocker arms of a valve train assembly of an internal combustion engine, the actuation arrangement comprising:

a first shaft comprising one or more first selector cams configured to control the latching arrangements of a first group of one or more of the dual body rocker arms;

a second shaft comprising one or more second selector cams configured to control the latching arrangements of a second group of one or more of the dual body rocker arms;

a first 2-step actuation source configured to rotate the first shaft; and a second 2-step actuation source configured to rotate the second shaft, wherein at least a first portion of the first shaft is received in the second shaft, and the first shaft and the second shaft are controllable to rotate independently of one another, thereby to allow control of the latching arrangements of the dual body rocker arms on a per group basis, and wherein a second portion of the first shaft extends through at least a portion of the second actuation source.

2. The actuation arrangement according to claim 1, wherein the second shaft defines a channel extending therethrough in which the first portion of the first shaft is received and in which the first portion of the first shaft is arranged to freely rotate.

3. The actuation arrangement according to claim 2, wherein the channel and the first portion of the first shaft are substantially cylindrical.

4. The actuation arrangement according to claim 1, wherein the first shaft and the second shaft are substantially coaxial.

5. The actuation arrangement according to claim 2, wherein the first actuation source is mechanically connected to the second portion of the first shaft.

6. The actuation arrangement according to claim 2, wherein the first actuation source and the second actuation source form an integral unit.

7. The actuation arrangement according to claim 2, wherein the first actuation source and/or the second actuation source comprises a torque motor.

8. The actuation arrangement according to claim 2, wherein the first actuation source comprises a first torque motor and the second actuation source comprises a second torque motor.

9. A valve train assembly, comprising:

the actuation arrangement according to claim 1; and the plurality of dual body rocker arms.

10. The valve train assembly according to claim 9, wherein each dual body rocker arm of the plurality of dual body rocker arms comprises a first body, a second body, and a latching arrangement configured to latch and unlatch the first body and the second body.

11. The valve train assembly according to claim 9, wherein each of the dual body rocker arms are configured to control a valve of the internal combustion engine, the first group comprises at least two of the dual body rocker arms each configured to control a valve of a first cylinder of the internal combustion engine, and the second group comprises at least two of the dual body rocker arms each configured to control a valve of a second cylinder of the internal combustion engine.

12. The actuation arrangement according to claim 1, wherein the first actuation source comprises a first rotor and a first stator, the second actuation source comprises a second rotor and a second stator, and the second rotor and second stator define a substantially cylindrical cavity that is coaxial with the second shaft.

13. The actuation arrangement according to claim 12, wherein the second shaft defines a channel extending therethrough, and wherein the second portion of the first shaft extends beyond the channel and through the substantially cylindrical cavity.

14. The actuation arrangement according to claim 13, wherein the second portion of the first shaft that extends beyond the channel and through the substantially cylindrical cavity is connected to the first rotor.

15. The actuation arrangement according to claim 1, wherein the first actuation source comprises a first rotor and the second actuation source comprises a second rotor, wherein the first rotor is on a side of the first actuation source facing away from the second shaft, and wherein the second rotor is on a side of the second actuation source facing towards the second shaft.

16. The actuation arrangement according to claim 15, wherein first actuation source and the second actuation source are packaged or housed in a single body.

17. The actuation arrangement according to claim 1, wherein first actuation source and the second actuation source are packaged or housed in a single body.

18. The actuation arrangement according to claim 1, wherein at least one of the 2-step actuation sources is an electromagnetic 2-step actuation source.

19. An actuation arrangement for actuating a plurality of latching arrangements of a respective plurality of dual body rocker arms of a valve train assembly of an internal combustion engine, the actuation arrangement comprising:

a first shaft comprising at least one first selector cam configured to control the latching arrangements of a first group of one or more of the dual body rocker arms;

a second shaft comprising at least one second selector cam configured to control the latching arrangements of a second group of one or more of the dual body rocker arms;

a first actuation source configured to rotate the first shaft; and a electromagnetic actuation source configured to rotate the second shaft, wherein at least a first portion of the first shaft is received in the second shaft, and the first shaft and the second shaft are controllable to rotate independently of one another, thereby to allow control of the latching arrangements of the dual body rocker arms on a per group basis, wherein a second portion of the first shaft extends through at least a portion of the second actuation source, and wherein at least one of the actuation sources is an electromagnetic actuation source.

* * * * *